US008196681B2

(12) United States Patent
Bick

(10) Patent No.: US 8,196,681 B2
(45) Date of Patent: Jun. 12, 2012

(54) EARTH BORING DEVICE

(76) Inventor: Thad Bick, Berkey, OH (US)

( * ) Notice: Subject to any disclaimer, the term of this patent is extended or adjusted under 35 U.S.C. 154(b) by 342 days.

(21) Appl. No.: 12/480,880

(22) Filed: Jun. 9, 2009

(65) Prior Publication Data

US 2009/0301779 A1 Dec. 10, 2009

Related U.S. Application Data

(60) Provisional application No. 61/059,898, filed on Jun. 9, 2008.

(51) Int. Cl.
*E21B 17/22* (2006.01)
*E21B 10/44* (2006.01)
*H02G 9/00* (2006.01)

(52) U.S. Cl. ..... 175/323; 175/310; 175/394; 405/174; 405/184

(58) Field of Classification Search ..... 175/45, 175/61, 310, 323, 394; 405/159, 160, 174, 405/175, 154.1, 184
See application file for complete search history.

(56) References Cited

U.S. PATENT DOCUMENTS 3,326,008 A * 6/1967 Baran et al. ..... 405/184
3,391,544 A 7/1968 Daczko
3,554,302 A * 1/1971 Adkins et al. ..... 175/26
3,794,128 A * 2/1974 Gagen et al. ..... 175/73
4,108,256 A * 8/1978 Moore, III ..... 175/61
4,726,711 A * 2/1988 Tian ..... 405/184
4,787,463 A * 11/1988 Geller et al. ..... 175/45
5,255,749 A * 10/1993 Bumpurs et al. ..... 175/26
5,337,002 A 8/1994 Mercer
5,695,017 A 12/1997 Gessner
6,315,062 B1 11/2001 Alft et al.
6,467,557 B1 10/2002 Krueger et al.
6,679,559 B2 1/2004 Kelm
6,688,408 B2 * 2/2004 Barbera et al. ..... 175/45
6,833,795 B1 12/2004 Johnson et al.
7,389,831 B2 * 6/2008 Mullins et al. ..... 175/62
7,591,329 B2 * 9/2009 Perpezat et al. ..... 175/384
7,976,243 B2 * 7/2011 Rohde et al. ..... 405/184
2002/0043404 A1 4/2002 Trueman et al.
2007/0023207 A1 * 2/2007 Perpezat et al. ..... 175/394
2008/0073123 A1 * 3/2008 Mullins et al. ..... 175/62
2008/0124178 A1 * 5/2008 Rohde et al. ..... 405/184.5

* cited by examiner

*Primary Examiner* — Jennifer H Gay
(74) *Attorney, Agent, or Firm* — Fraser Clemens Martin & Miller LLC; J. Douglas Miller

(57) ABSTRACT

An earth boring device for forming horizontally extending bore holes beneath the surface of the earth and installing a conduit therein without substantially disturbing the surface of the earth is disclosed. The earth boring device is a generally elongate member having a cutting tool disposed at a leading end, and means to attach a conduit to be disposed in the bore hole at a trailing end. A pair of spaced apart drive augers is disposed between the leading end and the trailing end to propel the earth boring device through the earth. The earth boring device can include at least one flexible section to enable a bending of the earth boring device for boring a curved bore hole.

17 Claims, 2 Drawing Sheets

EARTH BORING DEVICE

CROSS-REFERENCE TO RELATED APPLICATION

This application claims the benefit of U.S. Provisional Patent Application Ser. No. 61/059,898 filed on Jun. 9, 2008.

FIELD OF THE INVENTION

The invention relates to an boring device, and more specifically to an earth boring device for forming horizontally extending bore holes beneath the surface of the earth and installing a conduit therein without substantially disturbing the surface of the earth.

BACKGROUND OF THE INVENTION

It is frequently necessary or desirable to extend conduits or service transmission lines at shallow depths beneath the surface of the earth. Normally, a trench is formed in the surface of the earth for receipt of the conduit. The conduit is installed in the trench and the trench is subsequently back filled. Excavating disturbs the surface of the earth and substantially destroys any adjacent landscaping. The time and cost of installing the conduit are increased as a result of the excavating, backfilling, and restoring the surface of the earth to a desired condition.

Alternatively, various types of devices have been devised in the past for boring horizontally extending passageways through the earth such as those disclosed in U.S. Pat. No. 5,695,017 to Gessner, U.S. Pat. No. 6,315,062 to Alft et al., U.S. Pat. No. 6,467,557 to Krueger et al., U.S. Pat. No. 6,833,795 to Johnson et al., U.S. Pat. No. 5,337,002 to Mercer, and U.S. Pat. No. 6,679,559 to Kelm, each of which is incorporated herein by reference in its entirety. Most of these prior art devices are limited to boring in a substantially straight line over a short length such as the width of a sidewalk or a driveway, for example, and require the boring device to be retracted to subsequently install the conduit. The time and cost of installing the conduit with the prior art horizontal boring devices are increased as a result of the limited directional control and length of the bore, and the necessity to retract the device prior to installing the conduit.

It would be desirable to have an earth boring device for boring horizontally beneath the surface of the earth and installing a conduit therein without substantially disturbing the surface of the earth.

SUMMARY OF THE INVENTION

Compatible and attuned with the present invention, an earth boring device for boring horizontally beneath the surface of the earth and installing a conduit therein without substantially disturbing the surface of the earth, has surprisingly been discovered.

The above objective, as well as others, may be achieved by a boring device for forming a bore hole in a material comprising a cutting tool disposed adjacent a leading end of the boring device; means to attach a conduit to be installed in the bore hole disposed adjacent a trailing end of the boring device; and a pair of spaced apart drive augers disposed between the leading end and the trailing end to advance the boring device in respect of the material.

The above objective may also be achieved by a method of installing a conduit in a material including the steps of providing a device for forming a bore hole in a material; attaching a conduit to be installed in the material to the device; causing the device to advance through the material to form the bore hole therein; and detaching the conduit from the device upon the emergence of the device from the material to dispose the conduit in the bore hole.

BRIEF DESCRIPTION OF THE DRAWINGS

The above, as well as other objects and advantages of the invention, will become readily apparent to those skilled in the art from the following detailed description of an embodiment of the invention when considered in the light of the accompanying figures, in which.

DETAILED DESCRIPTION OF THE PREFERRED EMBODIMENTS

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and the order of the steps is not regarded as necessary or critical.

Figure 1:
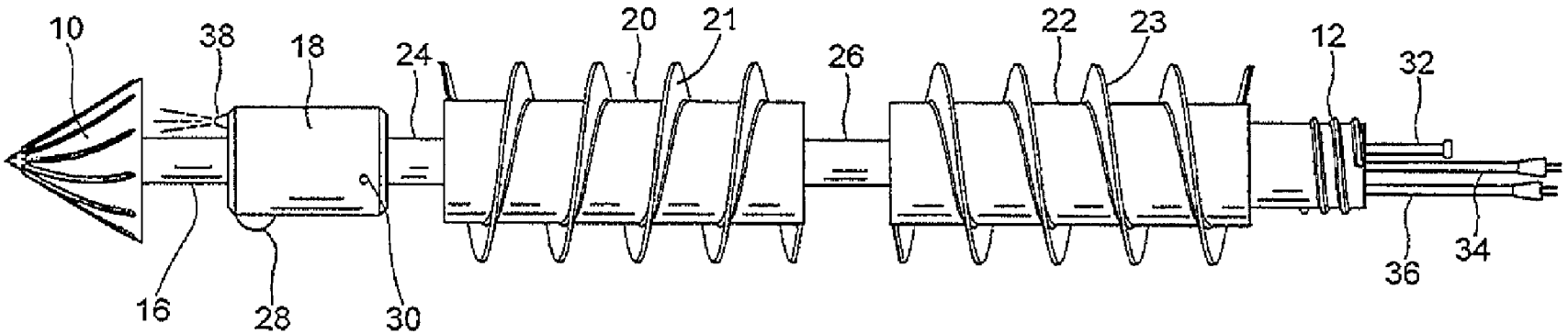
FIG. 1 is a side elevational view of an earth boring auger according to an embodiment of the invention.
Figure 2:
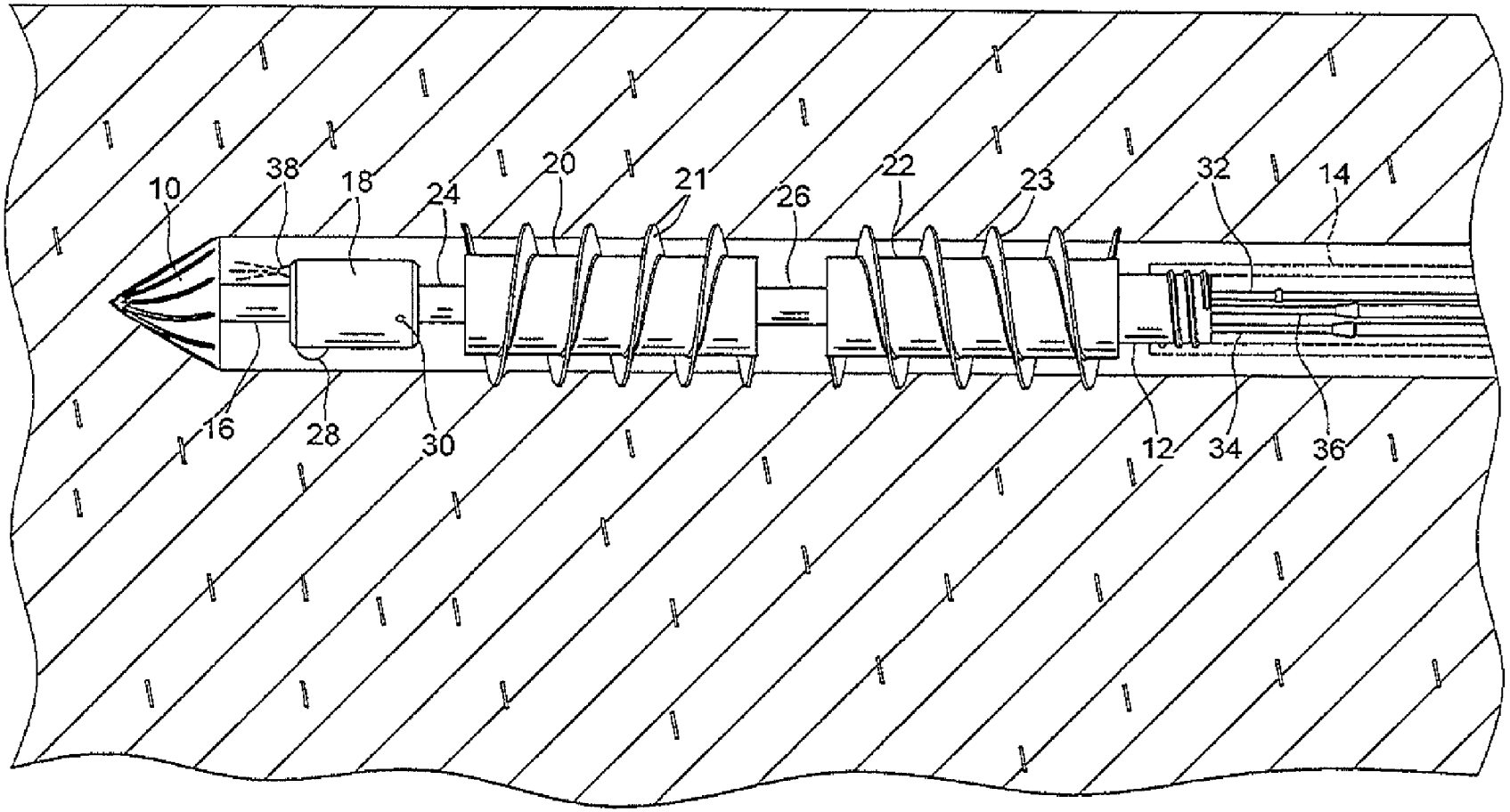
FIG. 2 is a side elevational view of the earth boring auger forming a horizontally extending bore hole in the earth and installing an associated conduit therein.

Referring to FIGS. 1 and 2, there is illustrated an earth boring device for forming a horizontally extending bore hole beneath the surface of the earth and installing a conduit therein. The earth boring device is a generally elongate member having a cutting tool 10 disposed at a leading end, and a connector 12 to attach a conduit 14 to be disposed in the bore hole at a trailing end. In the illustrated embodiment, the connector 12 is a threaded connecter. It should be understood that a threaded coupling, a quick connect coupling, a compression fit coupling, or other suitable connector can be employed for the connector 12 or with the connector 12. The earth boring device includes a control device (not shown) adapted to monitor and control the operation of the earth boring device.

The cutting tool 10 is coupled to a shaft 16 of an electric motor 18 employed to drive the cutting tool 10. The cutting tool 10 is normally in substantial longitudinal alignment with the earth boring device. The cutting tool 10 is adapted to be manipulated employing an actuator to move the cutting tool out of longitudinal alignment with the boring device and cause a change in direction of the forward travel thereof. It should be understood that the cutting tool includes one or more cutting edges and may be a spade style cutter, a generally cone shaped cutter, or any other suitable earth boring cutter now known or later developed. It should be understood that other means can be employed to drive the cutting tool 10 such as a pneumatic or a hydraulic drive, for example. In the illustrated embodiment the electric motor 18 is disposed within a housing.

A pair of spaced apart drive augers 20, 22 is provided to drive the assemblage of the cutting tool 10, the motor 18, and the connector 12 through the formed bore hole. The augers 20, 22 include flutes 21, 23, respectively, which are oppositely pitched. The augers 20, 22 and are adapted to rotate about a longitudinal axis. It should be understood that the augers may be caused to rotate in opposite directions to minimize any torque applied to the attached conduit 14. The augers 20, 22 are provided with suitable motors to cause the augers 20, 22 to rotate about the longitudinal axis. The augers 20, 22 are typically caused to be rotated in opposite directions about the longitudinal axis to minimize a torque on the conduit 14. It should be understood that the motors employed to drive the augers 20, 22 include an electrical motor, a pneumatic, or a hydraulic drive, for example. It should be understood that the electric motor 18 drivingly connected to the cutting tool 10 can also be employed to rotate the augers 20, 22. Additionally, a gear box or transmission, for example, can be provided to transmit a drive torque or a drive force from the motor 18 to the cutting tool 10; to transmit a drive torque or a drive force from the motor 18 to the cutting tool 10 and/or the augers 20, 22; or to transmit a drive torque or a drive force from the motor employed to cause the augers 20, 22 to rotate.

The earth boring device includes flexible connectors 24, 26 between the motor 16 and the auger 20, and between the augers 20, 22, respectively. The flexible connectors 24, 26 enable the earth boring device to form a curved bore hole. A sonar device or other sensing device 28 is provided to detect an obstruction, such as a rock or a utility service pipe in the earth, for example. A signal from the sonar device 28 can be employed to stop the operation of the earth boring device or change a direction of travel of the earth boring device to avoid contact between the earth boring device and the detected obstruction.

The earth boring device includes at least one sensor 30 to facilitate a tracking thereof as it travels through the earth to form the bore hole. The sensor 30 can be adapted to cooperate with a global positioning system and the control device to cause the earth boring device to follow a predetermined path through the earth. Additionally, the sensor 30 can be employed to provide data to the control device in respect of the location of the earth boring device and/or operation conditions of the earth boring device such as a temperature of the electric motor 18, a drive torque or a drive force from the electric motor 18, RPM of the cutting tool 10 and/or drive augers 20, 22, for example.

An internal passage (not shown) is formed in the earth boring device that extends from the trailing end of the earth boring device to a location adjacent the leading end thereof. The internal passage houses a water line 32, at least one electrical power line 34, and other selected wires 36. It should be understood that the internal passage can house other conduits such as an air line or a hydraulic fluid line, for example. The water line 32 is in fluid communication with a remote source of water and adapted to provide a flow of water to a nozzle 38 adjacent the cutting tool 10. A solenoid operated valve (not shown) adapted to selectively control the flow of water through the water line 32 may be provided. The power line 34 is in communication with a remote source of electrical energy and provides electrical energy to the motor 18 and any other electrically powered devices such as the sonar device 28 and the sensors 30. The other selected wires 36, if provided, may be employed to provide communication between the control device and other selected members of the earth boring device such as the actuator or other means to manipulate the cutting tool 10, the solenoid operated valve for the water line 32, the sonar device 28, and the sensor 30, for example. It should be understood that the water line 32, the power line 34, and the other selected wires 36 can be and typically are joined to associated extension lines temporarily housed within the conduit 14. The extension lines extend through the conduit 14 to connect to the respective remote sources of water and electrical energy, and the control device. Additionally, it should be understood that a wireless communication system may be employed to communicate between the control device and the other selected members of the earth boring device, thus eliminating at least a portion of the other selected wires 36.

In use, the earth boring device is employed to form a horizontally extending bore hole beneath the surface of the earth and simultaneously install a conduit therein. The water line 32, the power line 34, and the other selected wires 36 extending from the trailing end of the earth boring device are joined to associated extension lines temporarily housed within the conduit 14. The extension lines extend through the conduit 14 and are connected to the respective remote sources of water and electrical energy, and the control device. One end of the conduit 14 is attached to the trailing end of the earth boring device employing the connector 12.

Typically, the earth boring device is positioned at the surface of the earth at a desired starting point or an open end of the bore hole to be formed. However, it should be understood that a service ditch or a hole can be dug into the earth adapted to receive the earth boring device and allow the earth boring device to be positioned at a desired distance below the surface of the earth. The control device is then utilized by a user to energize the earth boring device and begin forming the bore hole into the earth.

The cutting tool 10 is caused to rotate by energizing the motor 18. The rotation of the cutting tool 10 breaks up the earth adjacent thereto. A stream of water is sprayed from the nozzle 38 adjacent the cutting tool 10 to facilitate breaking up the earth. The cutting tool 10 mixes the water with the broken-up earth to form a mud or a slurry. The mud or slurry flows from the area adjacent the cutting tool 10; past the earth boring device; through the bore hole; and out of the open end of the bore hole. It should be understood that openings (not shown) can be formed in the flutes 21, 23 of the augers 20, 22 to facilitate the flow of the mud or slurry past the earth boring device.

The augers 20 and 22 are caused to rotate about the longitudinal axis of the earth boring device to propel the earth boring device through the earth and pull the attached conduit 14 therethrough. The diameter of the augers 20 and 22 are larger than the diameter of the cutting tool 10 and the bore hole formed thereby. The flutes 21, 23 of the augers 20 and 22 engage the unbroken earth forming the inner surface of the bore hole being bored to propel the earth boring device through the earth. The augers 20 and 22 cause the water emitted from the nozzle 38 to mix with the broken-up earth and form the mud or slurry. The mud or slurry is under pressure and thereby is caused to flow past the earth boring device. The flutes 21, 23 of the augers 20 and 22 are oppositely pitched and are caused to rotate in opposite directions to minimize any torque applied to the attached conduit 14. It should be understood that the augers 20 and 22 can propel the earth boring device in a forward direction or in a reverse direction toward the initial opening of the bore hole.

The control device is employed to manipulate the cutting tool 10 and the rotation of the augers 20, 22 to cause the earth boring device to follow a desired path through the earth. It should be understood that a preprogrammed path can be employed to control the direction of the earth boring device through the earth, or a manual control can be employed to control the direction of the earth boring device. Additionally, the manual control can be utilized to override the preprogrammed path. It should be understood that the communication between the control device and the earth boring device can be through the wires 36 or through a wireless communication system.

The sonar 28 provides a signal to the control device when an obstruction is detected. The signal from the sonar 28 can be employed to provide a signal to the user; cause an emergency stopping of the earth boring device; or a change in direction of the forward travel of the earth boring device. The sensors 30 can provide signals to the control device representing operational information and location information of the earth boring device. The signals can be employed to provide information to the user or to control the operation of the earth boring device.

To complete the forming of the horizontally extending bore hole beneath the surface of the earth, the earth boring device is caused to emerge from beneath the surface of the earth at a desired location, or received within an associated service ditch, to form an opposing open end of the bore hole. The conduit 14 is detached from the connector 12, and the water line 32, the power line 34, and the other selected wires 36 extending from the trailing end of the earth boring device are disconnected from the associated extension lines. The extension lines are removed from within the conduit 14 leaving the conduit 14 in the bore hole and extending from the open end to the opposing open end thereof. The conduit 14 is installed beneath the surface of the earth and can be employed for housing wires, cables, or the like; or for providing a fluid communication path through the earth, for example.

The earth boring device is useful for forming horizontally extending bore holes beneath the surface of the earth and installing the conduit 14 therein without substantially disturbing the surface of the earth. The earth boring device can form a bore hole through the earth having a desired length while simultaneously pulling the associated conduit 14 therethrough. The earth boring device minimizes the cost and time of installing the conduit 14 by eliminating the need to excavate a trench along the entire path for the conduit 14 together with backfilling the trench and restoring the surface of the earth to a desired condition. Additionally, the cost and time of installing the conduit 14 are decreased as a result of the directional control of the earth boring device and the length of the bore hole that can be formed with the earth boring device.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A boring device for forming a bore hole in a material comprising:

a cutting tool disposed adjacent a leading end of the boring device;

a connector disposed adjacent a trailing end of the boring device to attach a conduit to be installed in the bore hole;

a pair of spaced apart drive augers disposed between the leading end and the trailing end to advance the boring device in respect of the material, the drive augers including flutes disposed thereon, wherein the flutes on one drive auger are oppositely pitched in respect of the flutes on the other drive auger; and a drive coupled to at least one of the cutting tool and the drive augers adapted to cause a rotation thereof.

2. The boring device of claim 1, wherein the cutting tool is adapted to be manipulated to change a direction of the advancement of the boring device.

3. The boring device of claim 1, including a sensing device adapted to detect obstructions in the material.

4. The boring device of claim 1, including a sensing device adapted to provide a signal effective to track a position of the boring device in the material.

5. The boring device of claim 1, including a sensing device adapted to detect operating conditions of the boring device.

6. The boring device of claim 1, including a flexible connector disposed between the drive augers.

7. The boring device of claim 1, including a flexible connector disposed between the drive and at least one of the drive augers.

8. The boring device of claim 1, including a nozzle adjacent the cutting tool, the nozzle in fluid communication with a source of fluid and adapted to provide a flow of fluid adjacent the cutting tool.

9. The boring device of claim 8, including a fluid conduit disposed within the boring device in fluid communication with the nozzle and the source of fluid.

10. The boring device of claim 1, including a plurality of wires in electrical communication with the drive.

11. A boring device for forming a bore hole in a material comprising:

a cutting tool disposed adjacent a leading end of the boring device;

a connector disposed adjacent a trailing end of the boring device to attach a conduit to be installed in the bore hole;

a pair of spaced apart drive augers disposed between the leading end and the trailing end to advance the boring device in respect of the material, the drive augers including flutes disposed thereon, wherein the flutes on one drive auger are oppositely pitched in respect of the flutes on the other drive auger;

a flexible connector disposed between the drive augers;

a nozzle disposed adjacent the cutting tool, the nozzle in fluid communication with a source of fluid and adapted to provide a flow of fluid adjacent the cutting tool; and a drive coupled to at least one of the cutting tool and the drive augers adapted to cause a rotation of the at least one of the cutting tool and the drive augers.

12. The boring device of claim 11, wherein the cutting tool is adapted to be manipulated to change a direction of the advancement of the boring device.

13. The boring device of claim 11, including a sensing device adapted to detect obstructions in the material.

14. The boring device of claim 11, including a sensing device adapted to provide a signal effective to track a position of the boring device in the material.

15. The boring device of claim 11, including a sensing device adapted to detect operating conditions of the boring device.

16. The boring device of claim 11, including a fluid conduit disposed within the boring device in fluid communication with the nozzle and the source of fluid.

17. The boring device of claim 11, including a plurality of wires in electrical communication with the drive.

* * * * *